US011607726B2

(12) United States Patent
Feiner et al.

(10) Patent No.: US 11,607,726 B2
(45) Date of Patent: Mar. 21, 2023

(54) METHOD FOR CENTERING A POURING TUBE IN A POURING TUBE ASSEMBLY

(71) Applicant: Selee Advanced Ceramics, Gilberts, IL (US)

(72) Inventors: Eric Feiner, Gilberts, IL (US); Jose Torres, Gilberts, IL (US); Steven Mangin, Gilberts, IL (US); Kurt Schiefelbein, Gilberts, IL (US)

(73) Assignee: SELEE ADVANCED CERAMICS, Gilberts, IL (US)

( * ) Notice: Subject to any disclaimer, the term of this patent is extended or adjusted under 35 U.S.C. 154(b) by 0 days.

(21) Appl. No.: 17/589,246

(22) Filed: Jan. 31, 2022

(65) Prior Publication Data

US 2022/0152697 A1 May 19, 2022

Related U.S. Application Data

(62) Division of application No. 17/095,232, filed on Nov. 11, 2020, now Pat. No. 11,273,487.

(60) Provisional application No. 62/934,865, filed on Nov. 13, 2019.

(51) Int. Cl.

| | |
|---|---|
| ***B22D 41/50*** | (2006.01) |
| ***B22D 18/04*** | (2006.01) |
| ***B22D 35/04*** | (2006.01) |

(52) U.S. Cl.

CPC ..... *B22D 41/505* (2013.01); *B22D 18/04* (2013.01); *B22D 35/04* (2013.01)

(58) Field of Classification Search

CPC ..... B22D 41/50; B22D 41/505; B22D 18/04; B22D 35/04

See application file for complete search history.

(56) References Cited

U.S. PATENT DOCUMENTS

| | | | | | |
|---|---|---|---|---|---|
| 2,874,424 | A * | 2/1959 | Zickefoose | B22D 18/04 | 164/DIG. 14 |
| 3,279,003 | A * | 10/1966 | Yates | B22D 41/50 | 138/109 |
| 3,322,186 | A * | 5/1967 | Takacs, Jr. | B22D 35/04 | 164/337 |
| 3,651,860 | A * | 3/1972 | Ebeling | B22D 18/04 | 164/339 |
| 5,919,392 | A * | 7/1999 | Myers | B22D 35/04 | 222/606 |

* cited by examiner

*Primary Examiner* — Kevin E Yoon
(74) *Attorney, Agent, or Firm* — Kirk A. Wilson; Joseph T. Guy; Patent Filing Specialist Inc.

(57) ABSTRACT

The present invention is related to a method for centering a pouring tube in a pouring tube assembly using a multi-piece centering sleeve by inserting a pouring tube into a holding casting aperture in a holding casting; pouring grout to fill a portion of a gap between the pouring tube and the holding casting; slipping the centering sleeve over the outside of the pouring tube until it is press fit in a portion of the gap between the pouring tube and the holding casting; adjusting the centering sleeve to center-position the pouring tube; grouting the remainder of the gap to fill all voids in the gap; installing a parting ring on top of the holding casting; and installing a holding ring around the holding casting and parting ring.

8 Claims, 8 Drawing Sheets

METHOD FOR CENTERING A POURING TUBE IN A POURING TUBE ASSEMBLY

CROSS-REFERENCE TO RELATED APPLICATIONS

The present invention claims priority to U.S. Provisional Patent Application No. 62/934,865, filed Nov. 13, 2019, and is a divisional application of U.S. Utility patent application Ser. No. 17/095,232, filed Nov. 11, 2020, both of which are incorporated herein by reference in their entirety.

FIELD OF THE INVENTION

The present invention is related to a method for centering a pouring tube in a pouring tube assembly using a multi-piece centering sleeve in a pouring tube structure. The present invention is a suitable method for supporting and centering a pouring tube in an associated pouring tube structure wherein molten metal passes through the pouring tube to fill a mold such as a mold for forming an ingot or the like.

BACKGROUND

The present invention is related to a bottom pouring technique for casting molten metal. The technique utilizes an elongated tube, lined with a refractory material, wherein the top of the tube mates with the bottom of the mold for the part to be cast. A channel extends from the bottom of the elongated tube to the base of the open ingot mold with open outlets exposed to the interior of the mold. This technique, referred to in the art as bottom-pressure casting, provides ingots with greater recovery of as-cast steel as set forth in detail in U.S. Pat. Nos. 5,919,392 and 6,932,144, which are incorporated herein, in their entirety, by reference.

A particular problem with bottom-pressure casting is transferring the molten metal up the pour tube to the mold and maintaining alignment/centering of the assembly. This transfer requires the presence of pressurized gas above the molten metal within a sealed ladle or holding tank. The pressure forces the molten metal up the pouring tube. A seal must be maintained between the holding casting and pouring tube to allow a steady gas pressure for optimization of the metal flow.

As would be realized the environment associated with transferring molten metal is harsh which necessitates the replacement of those parts contacting the molten metal. The pour tube, for example, typically last for about 50 pours depending on the molten metal, residence time at temperature, transfer rate and other related issues. It is therefore necessary to replace many parts of the assembly fairly frequently which is undesirable but necessary.

In spite of the advanced nature of the art alignment of the pouring tube and ingate are still problematic which contributes to the eroded ingate material being incorporated in the cast. Yet another problem is the necessity for the operator to spend time maintaining the pouring gasket between the pouring tube and ingate. Yet another problem is the excessive use of mortar which is undesirable as the mortar increases the time required to assemble and disassemble the device.

SUMMARY OF THE INVENTION

The invention relates to a method for centering a pouring tube in a pouring tube assembly using a multi-piece centering sleeve in a pouring tube structure.

A particular feature of the instant invention is the increased efficiency associated with the decreased effort required to change a used pouring tube.

Yet another feature is the reduced reliance on cementitious refractory material, or mortar, relative to the conventional systems in the art.

A particular feature is the ability to utilize the invention without modification of existing installed systems and without a redesign of the pouring tube.

A pouring tube assembly is configured for insertion into a holding tank arrangement for casting molten metals. The pouring tube assembly comprises a holding tank assembly capable of containing a molten metal; a holding casting, a parting ring, a holding ring, a plate metal top; a pouring tube in flow communication with the holding tank assembly wherein the pouring tube is removably disposed in said pouring tube assembly and capable of receiving the molten metal from said holding tank assembly and depositing said molten metal in a mold positioned above said pouring tube; and a centering sleeve removably disposed between said pouring tube and a portion of said holding casting, wherein said centering sleeve comprises at least two mating sleeve portions wherein each sleeve portion of said sleeve portions is configured with symmetrically disposed protrusions and recesses positioned on adjacent sleeve portions, wherein each protrusion of said protrusions comprises a ledge and adjacent ledges and protrusions of said mating sleeve portions engage to form the centering sleeve.

These and other embodiments, as will be realized, are provided in a pouring tube assembly.

DETAILED DESCRIPTION

The present invention is related to a mold centering sleeve for a pouring tube structure. More specifically, the present invention is related to an improved mold centering sleeve comprising tapered portions which function in concert to form a wedge wherein the wedge is tapered on the outside diameter to match the taper of a holding casting. There is no taper on the inside diameter of the sleeve as the pouring tube is not tapered, however a tapered pouring tube and internal taper of the mold centering sleeve could be employed in some embodiments.

The mold centering sleeve of the pouring tube assembly provides laminar flow throughout the entire pouring path by improving the alignment between the pouring tube and the ingate. It also reduces the possibility of burnt pouring gasket material entering the casting as well as reducing the possibility of eroded ingate material entering the casting. This eliminates the need for an operator to work on the pouring cover by eliminating, or relocating the maintenance of, the pouring gasket positioned between the pouring tube and the ingate. The improved pouring tube assembly uses little or no mortar and can be assembled/disassembled in less time that is takes to prepare the current assemblies with the mortar.

Material options for the mold centering sleeve include graphite, steel, alumina, magnesia, calcia, and mullite. Options for securing the sleeve to tube include: integrated, for example cast/formed directly onto tube; mechanical, for example using pins, grooves for attachment; mortar in place, for example using mullite or graphite; and fired in place, for example using a ceramic bond.

The mold centering sleeve shape can be cylindrical or elliptical, depending on the shape of the pouring tube. The tapered profile of the sleeve acts as a mechanical wedge and is press fit into place, thereby placing the pouring tube in constant compression. The sleeve compensates for changes in pouring tube diameter as well as mortar build-up. The draft on the interior of casting can be constant with small changes in the interior diameter of casting over the entire service life.

The invention will be described with reference to the figures forming an integral, but non-limiting, component of the description. Throughout the description similar elements will be numbered accordingly.

Figure 1:
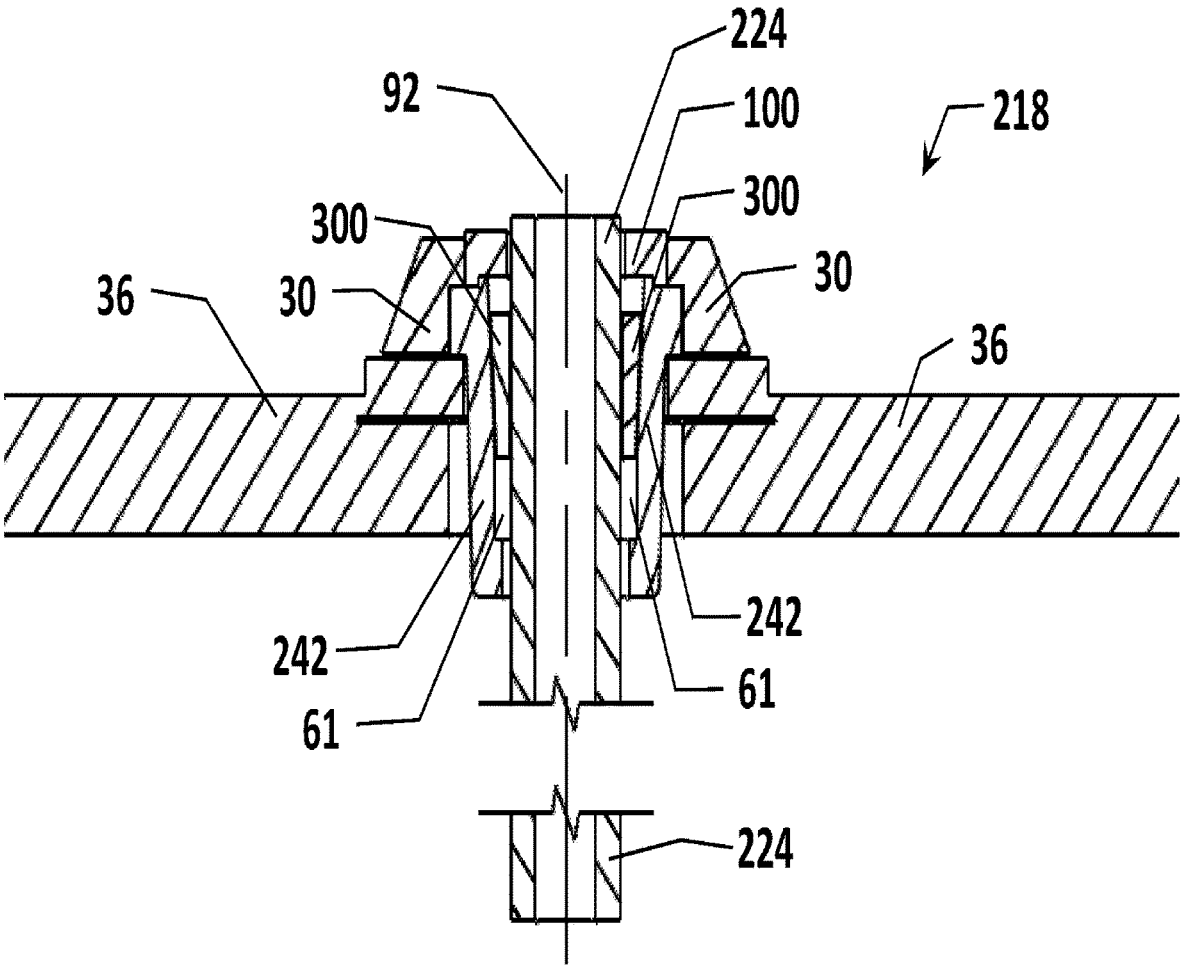
FIG. 1 is a schematic cross-sectional view illustrating an embodiment of the invention.
Figure 2:
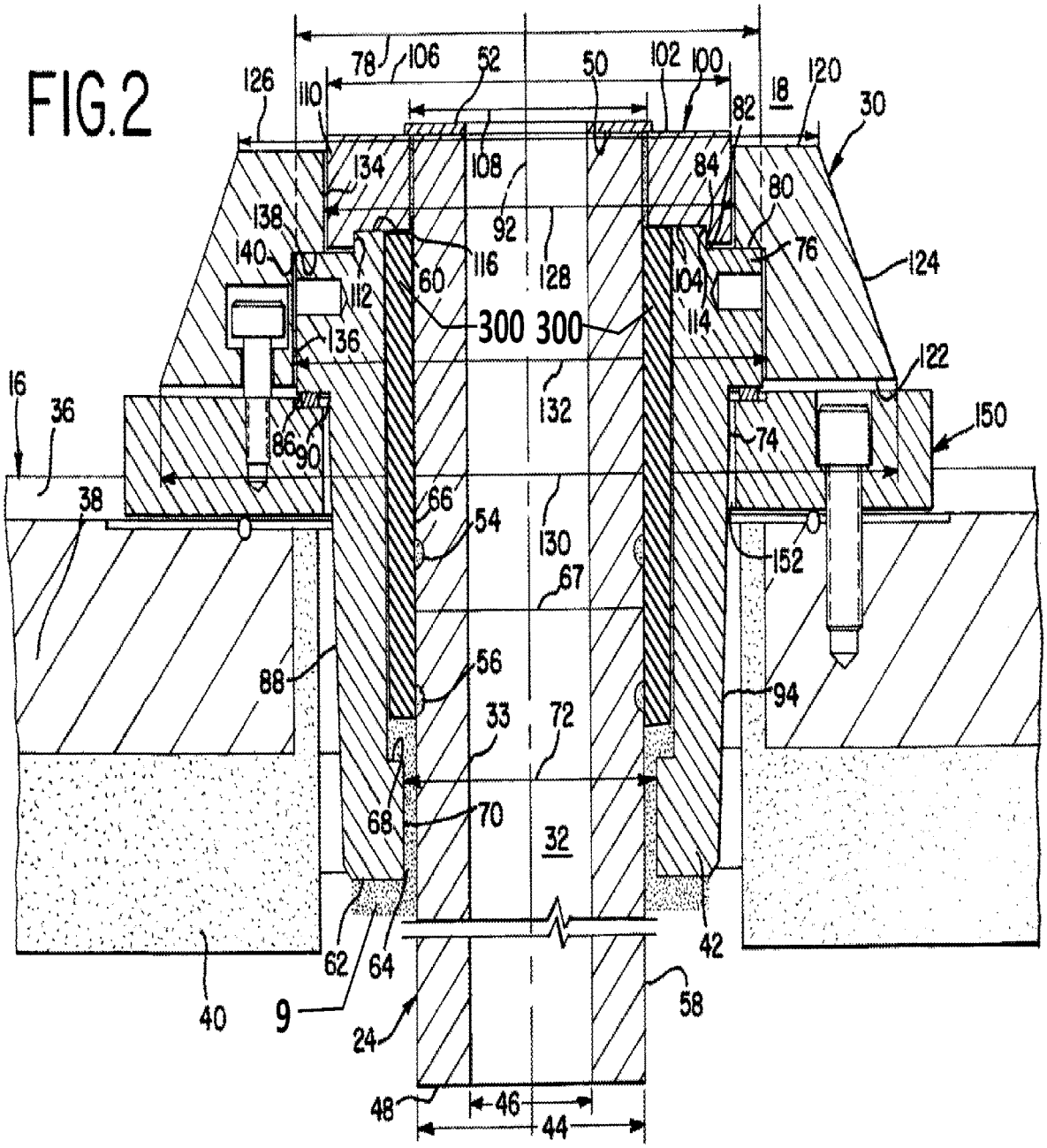
FIG. 2 is an enlarged cross-sectional elevational view of a pouring tube and tank cover assembly.

With reference to FIGS. 1 and 2, for the purposes of describing the invention, the instant invention is a sleeve 300 which is removably disposed between the pouring tube 224, and holding casting, 242 and therefore the sleeve resides in the area represented as gap 61, with the bulk of the mortar 9 used in the gap 61.

Figure 3:
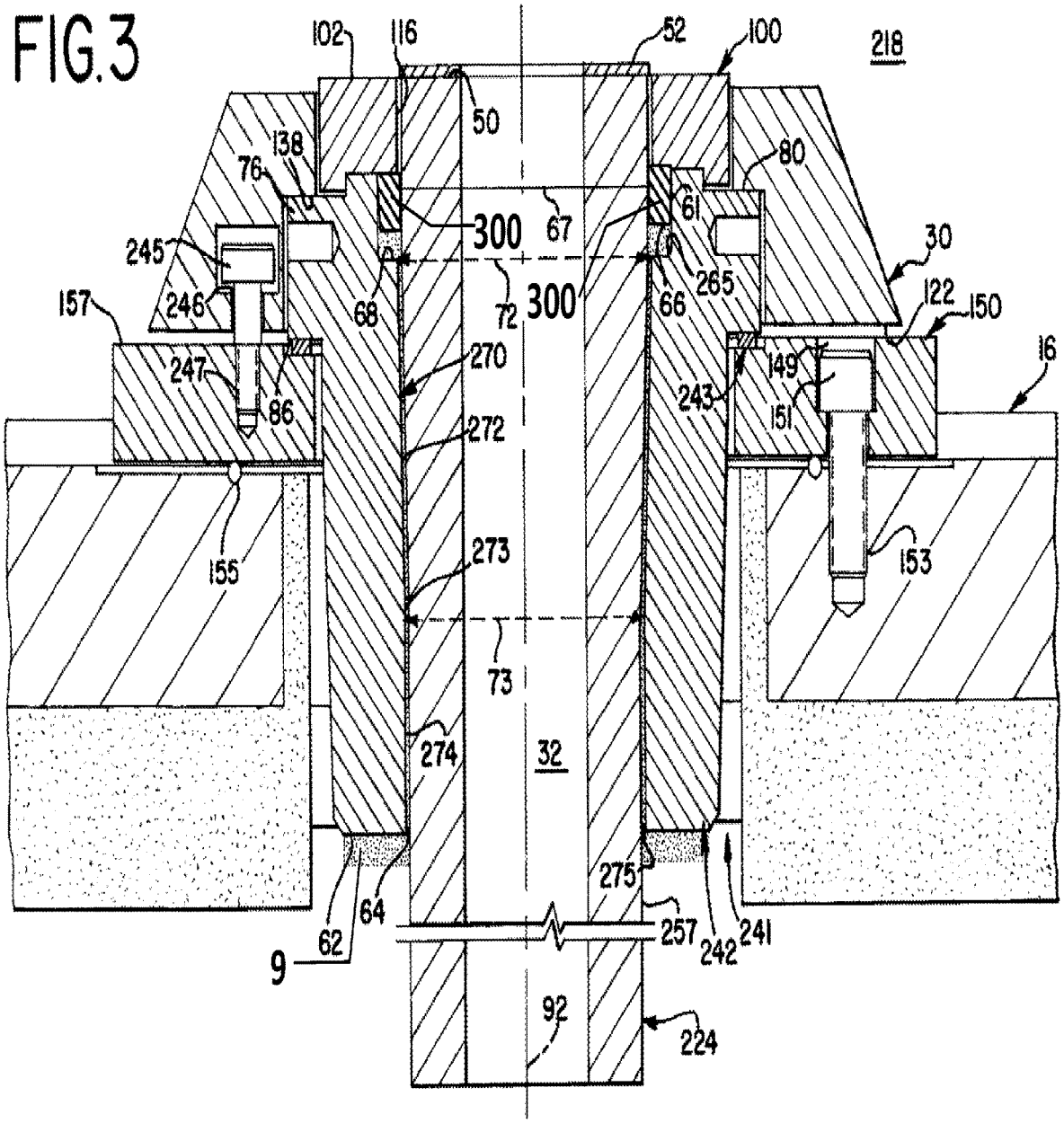
FIG. 3 is a cross-sectional elevational view of the pouring tube and tank cover assembly.

With reference to FIG. 1, the holding casting, 242, gap, 61, wall protrusion 68, inner wall, 66, shoulder, 265 and pouring tube, 224 are as described relative to FIG. 3. The centering sleeve, 300, which is formed of mating sleeve portions 302, as will be further described herein. An outer taper, 304, matches the inner taper of the gap. As would be realized downward force on the pouring tube forces an engaging relationship between the outside of the pouring tube and inside of the sleeve as well as between the outside of the sleeve and the inner wall. Optionally, but preferably, cementitious refractory material, or mortar 9, is between the mating surfaces of the sleeve 300 and pouring tube 224 as well as between the sleeve 300 and inner wall of the holding casting 242. As would be realized the amount of cementitious refractory material, or mortar 9, is significantly reduced relative to the embodiment as represented in FIG. 2.

FIG. 2 shows an exemplary pouring tube assembly, 18 with a centering sleeve 300 grouted in place between the pouring tube 24 and the holding casting 421*n* this enlarged cross-sectional view of FIG. 2, assembly, 18, has a pouring tube, 24, with an outer diameter, 44, and an inner or passage diameter, 46. Passage, 32, with inner wall, 33 is a cylinder extending from the tube lower end, 48, to the upper end, 50. A tube gasket, 52, is seated on the upper end, 50, to provide a better seat and seal for the mold which sits on the top and is in flow communication with the tube, 32. Tube, 32, may include a first circumferential slot, 54, and optional second circumferential slot, 56, on its outer wall, 58. Holding casting, 42, is generally cylindrical with top, 60, bottom, 62, and duct, 64, extending through casting, 42. A first inner wall, 66, of the casting, 42, has a first inner diameter, 67, extending from the top, 60, to the internal wall protrusion, 68. A second inner wall, 70, has a second inner diameter, 72, extending from the bottom, 62, to the wall protrusion, 68, wherein the second inner wall diameter, 72, is less than first inner wall diameter, 67. In FIG. 2, the holding casting outer wall, 74, has a collar, 76, with outer diameter, 78. The collar, 76, has an upper surface, 80, in proximity to, but downwardly displaced from, the top, 60, to form a first shoulder, 82, with a sidewall, 84. The lower surface, 86, of the collar, 76, intersects with the outer wall, 88, of holding-casting, 42, at a second shoulder, 90. The outer wall, 88, inwardly tapers from the second shoulder, 90, toward the longitudinal axis, 92, of tube, 24, and holding casting, 42, to intersect the bottom, 62. There is an inflection point or ridge, 94, in the slope of outer wall, 88, where the angle of the taper increases toward the longitudinal axis, 92.

A parting ring, 100, is about an annulus with top side, 102, bottom side, 104, outer diameter, 106 and inner diameter, 108. A parting-ring outer wall, 110, having an outer diameter, 106, vertically extends downward beyond the horizontal plane of the bottom side, 104, and includes the inner wall, 112. A shoulder, 114, occurs at the intersection of the parting-ring bottom side, 104, with inner wall, 112, which has an inner diameter, 118. A parting-ring bore, 116, has inner diameter, 108, which is larger than outer-wall diameter, 44, of tube, 24.

The holding ring, 30, in FIG. 2 has a cross-section which appears as an annulus with sloped outer walls, 124. In FIG. 2, holding ring, 30, has a central through-bore upper face, 120, with a first outer diameter, 126, and first inner diameter, 128. The lower face, 122, has a second outer diameter, 130, and second inner diameter, 132, wherein the second outer diameter, 130, is larger than the upper-face first outer diameter, 126, and the second inner diameter, 132, is greater than the first inner diameter, 128. The outer wall 124, is tapered from the first outer diameter, 126, to second outer diameter, 130, to provide ring, 30, as a generally frustum-shaped annulus. The holding-ring first inner wall, 134, with first inner diameter, 128, downwardly extends from the upper face, 120, to meet the horizontal internal wall, 138. The second inner wall, 136, which is displaced radially outward from axis, 92, and first inner wall, 134, upwardly extends from the lower face, 122, to intersect the horizontal internal wall, 138, at the shoulder, 140. The lower face, 122, of the ring, 30, contacts the support ring, 150, which also appears as an annular member and is positioned on tank cover, 16, with holding casting, 42, extending through support-ring central bore, 152. The tank cover, 16, has a plate metal top, 36, with a refractory material layer, 38 and heat cover.

Cementitious refractory material, or mortar, 9, is applied in passage 64 between pouring tube, 24, and holding casting, 42. A space or gap, 61, is not filled at the upper end of passage 64, as part of the assembly practice of tube assembly, 18, in FIG. 2. In practice this gap is preferably filled with mortar.

Figure 5:
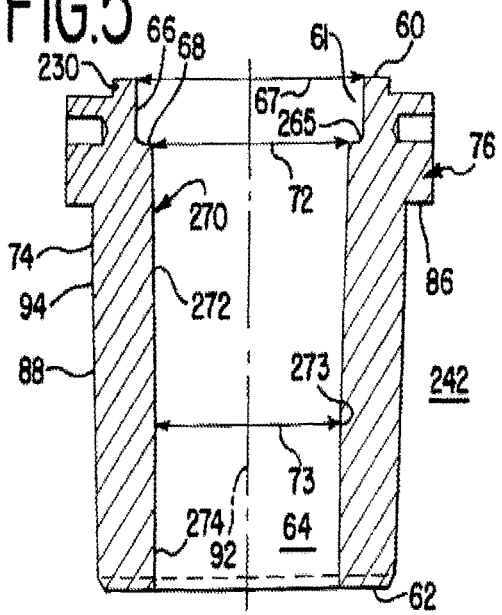
FIG. 5 is a cross-sectional view of the holding casting in FIG. 3.

Another exemplary bottom pouring tube assembly and holding tank arrangement are illustrated in FIG. 3. In FIG. 3 the assembly comprises a pouring-tube assembly, 218, with a holding casting, 242, pouring tube, 224, parting ring, 100, holding ring, 30, tube support ring, 150, and gasket, 52. In FIGS. 3 and 5 the holding casting, 242, has an internal wall protrusion, 68, in close proximity to the top. The intersection, or shoulder, 265, of the sidewall or first inner wall, 66, in holding casting, 242, preferably appears as a radius and not as a square corner.

Figure 6:
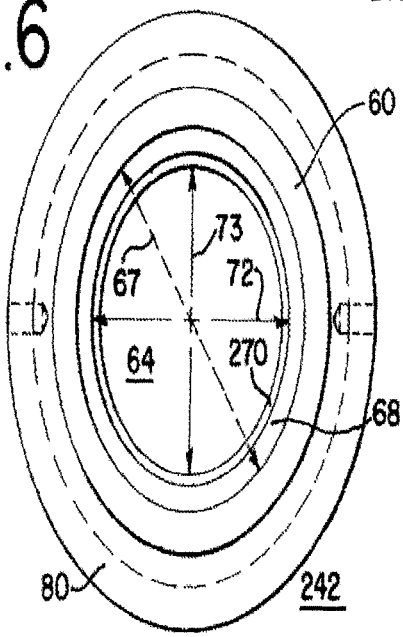
FIG. 6 is a plan view of the holding casting in FIG. 5.

Holding casting, 242, has a lower inner wall section, 270, extending from the internal wall protrusion, 68, to the bottom, 62. The tapered and upper inner wall segment, 272, of the wall section, 270, extends from the second diameter, 72, to the third inner diameter, 73, which is smaller than the second inner diameter, 72. The upper and tapered inner wall segment, 272, extends from the second inner diameter, 72, at the wall protrusion, 68, downward to the third inner diameter, 73. A lower and generally cylindrical segment, 274, generally vertically extends from the third inner diameter, 73, to the casting bottom, 62, and intersects the tapered segment, 272, at an inflection point, 273. In FIG. 5, the holding-casting, upper, outer-wall section, 74, extends generally vertically downward from a collar lower face, 86. At the outer-wall inflection point, 94, the lower outer wall section, 88, angularly tapers inward toward the axis, 92, to intersect the casting bottom, 62. The holding casting, 242, is shown in a plan view in FIG. 6, which illustrates the aperture, 64, the first inner diameter, 67, the second inner diameter, 72, and the third inner diameter, 73, as well as providing an illustration of the narrow inward taper of vertical wall, 270.

Figure 4:
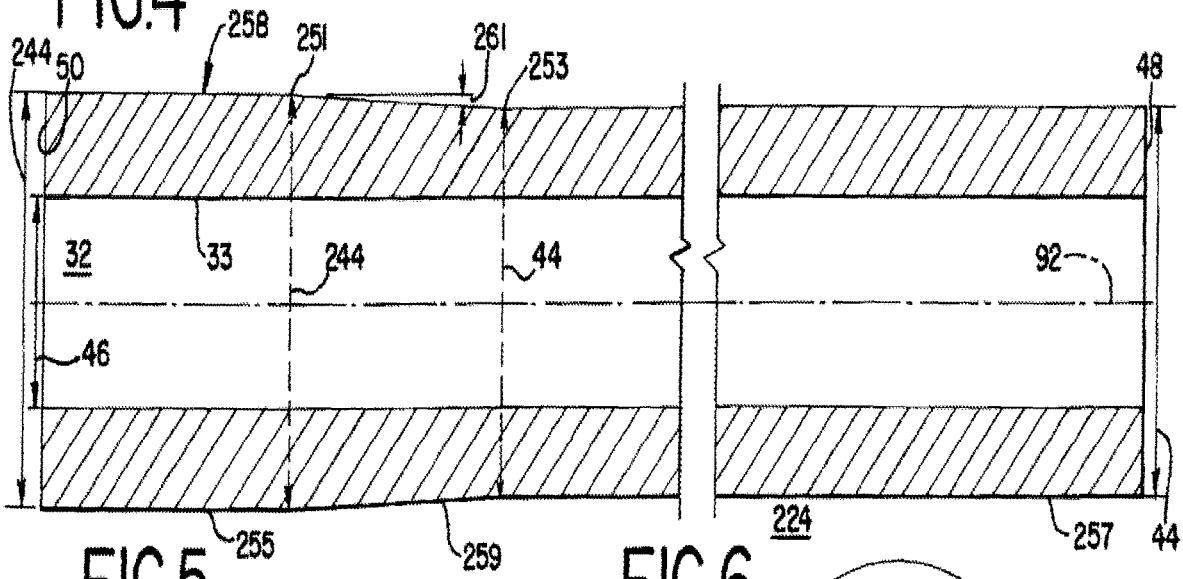
FIG. 4 is a cross-sectional view of the pouring tube in FIG. 3.

An optional flared pouring tube, 224, in FIGS. 3 and 4 has a longitudinal axis, 92, and an outer wall, 258. Passage, 32, is generally cylindrical and has an inner wall, 33, extending between the tube lower end, 48, and upper end, 50, wherein the tube lower end has an outer diameter, 44. The tube outer wall, 258, may have an upper segment, 255, with a second tube outer diameter, 244, extending from the upper end, 50, to the first inflection point, 251, illustrated in FIG. 4, wherein the second outer diameter, 244, at the tube top, 50, may be greater than the outer diameter, 44, at the tube bottom, 48. A tube, outer-wall, lower segment, 257, with an outer diameter, 44, extends generally vertically from the tube lower end, 48, to a second inflection point, 253, along wall, 258. A third and tapered outer-wall segment, 259, is inwardly tapered from the first inflection point, 251, to the second inflection point, 253, and diameter, 44. A third wall segment, 259, is illustrated in FIG. 4 with an inwardly tapering angle, 261, wherein the angle may be 2° from vertical, for example. Straight pouring tubes may be employed and are preferable.

Figure 7:
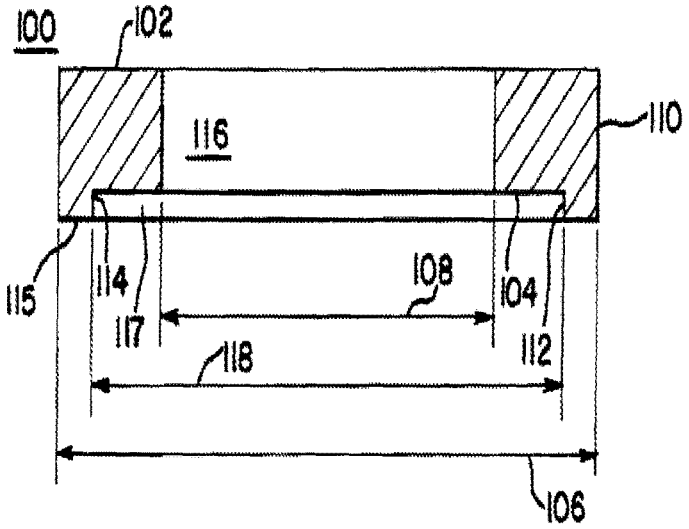
FIG. 7 is a cross-sectional elevation of the parting ring of the assembly of FIG. 3.
Figure 8:
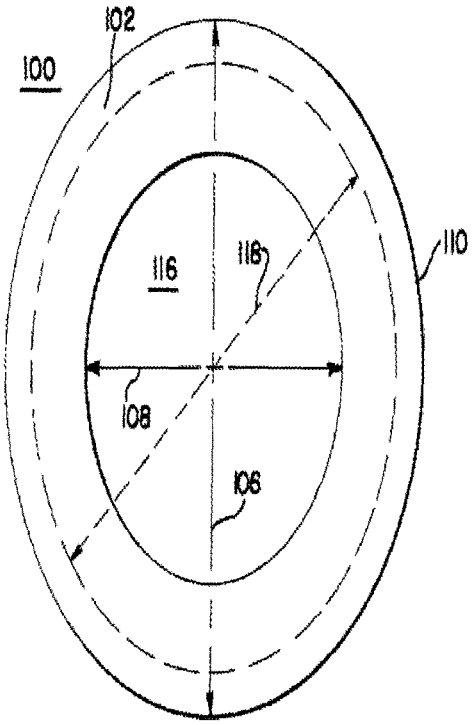
FIG. 8 is a plan view of the parting ring of FIG. 7.
Figure 9:
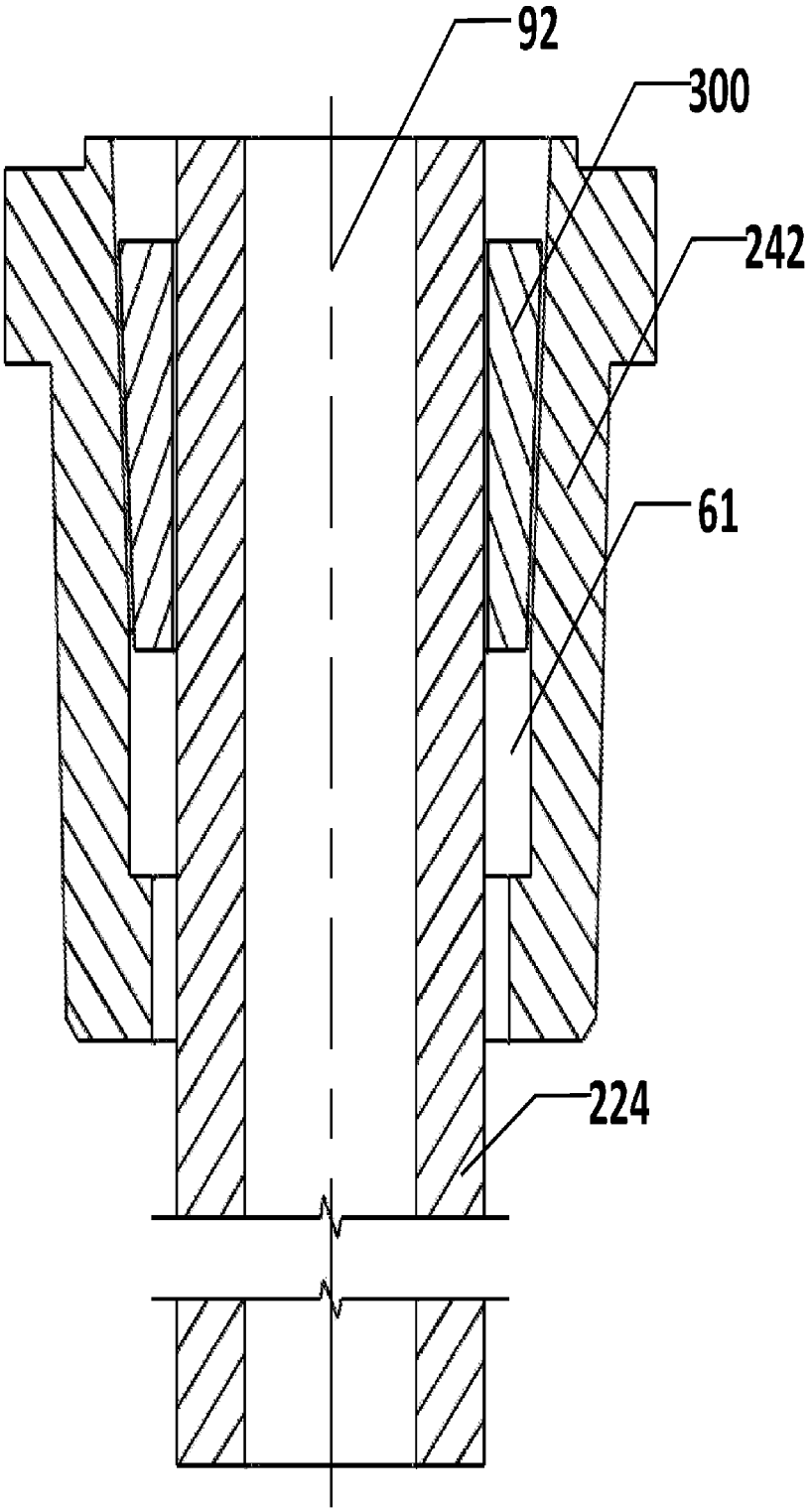
FIG. 9 is a cross sectional view of the centering sleeve positioned in a holding casting.

A parting ring, 100, is shown in FIGS. 7 and 8 having an inner diameter, 108, which is larger than diameter, 244, of the tube, 242. In FIG. 7, the wall, 112, with an inner diameter, 118, extends from the lower wall or bottom side, 104, to the outer bottom surface, 115, wherein the inner wall, 112, and lower wall, 104, provide recess, 117, to receive the upper surface, 60, of holding casting, 242.

In the illustration of FIG. 3, a tube support ring, 150, is seated on the tank cover, 16, and secured in position by screws, 151, extending through bores, 149, which are anchored in ports, 153, of cover, 16. Garlock gasket, 155, is nested between the tank cover, 16, and tube support ring, 150, to seal the surfaces between these two components and to avoid seepage or pressure loss during casting.

The holding casting, 242, is positioned in the opening 241, of tank cover 16, with a holding-casting-collar lower surface, 86, positioned on the tube-support-ring upper surface, 157, with a pouring tube gasket, 243, positioned there between to maintain a tight seal. The internal wall, 138, of holding ring, 30, contacts the upper surface, 80, of holding casting collar, 76, and the holding-ring lower face, 122, contacts tube-support-ring upper surface, 157. Screws, 245, of the holding ring, 30, extend through a passage, 246, to mate with support-ring passages, 247, and to secure holding ring, 30, to support ring, 150.

The pouring tube, 224, is placed in the holding-casting aperture, 64, with lower segment, 257, extending through aperture, 64. In this configuration, the holding-casting third inner diameter, 73, is approximately equal to, or slightly larger than the pouring tube outer diameter, 44, at the second inflection point, 253. Similarly, a tapered tube wall segment, 259, is sloped or tapered to generally conform to the slope of holding casting wall section, 270, between the holding casting inner diameter, 72, and inner diameter, 73. An upper section, 255, with outer diameter, 244, extends from the inflection point, 251, to the upper surface, 50. After assembly, a narrow gap, 275, exists between inner wall, 270, of holding casting, 242, and pouring tube outer wall, 258. This gap is filled with a centering sleeve 300 and a cementitious refractory compound, 9, also referred to as mortar, which provides both an anchoring and insulating material between the holding casting, 242, and pouring tube, 224. The centering sleeve 300 provides radial support of the pouring tube 224 in the holding casting aperture 64, thereby maintaining a centered position of the pouring tube 224 to mate with the ingate of a mold positioned above the pouring tube 224.

The parting ring, 100, is mated with the holding casting upper portion, 230, which has an outer diameter about equal to the parting ring inner diameter, 118, to nest parting ring, 100, on the upper portion, 104, in recess, 117. A tube upper segment, 255, extends past the holding casting top surface, 60, to mate with the parting-ring bore or port, 116. In this arrangement, tube upper surface, 50, is about coplanar with the parting-ring top surface, 102. Gasket, 52, is secured to the tube upper surface, 50, for receipt of a mold.

In an optional assembly 218, as shown in FIG. 3, pouring tube, 224, is firmly nested in the holding casting, 242. Upper segment, 255, has a larger diameter, 244, than lower diameter, 73, of the holding casting, 242. Consequently, tube, 224, is anchored in aperture, 64, by both the cementitious refractory material, 9, and by the mechanical force of gravity wedging the centering sleeve 300 between the tube wall, 258, and the holding casting wall, 270. The taper of the walls, 270 and 258, are approximately equal, and the outer diameters of tube, 224, are only smaller than the inner wall diameters of holding casting aperture, 64, to allow assembly of the components and the introduction of the cementitious refractory material 9. However, the narrow gap, 275, will not permit free passage of the tube, 224, through the holding-casting aperture, 64. Thus, positioning a mold, as known in the art, atop the holding tank cover, 16, and holding ring, 30, will more firmly nest the centering sleeve 300 and tube, 224, into holding casting, 242. This latter action is to prevent tube, 224, from being driven out of holding casting, 242.

In a preferred embodiment the pouring tube 224 is straight and maintained in a centered position by centering sleeve 300 and associated mortar 9. Tube, 224, has a length from the bottom, 48, to the upper end, 50, to allow tube, 224, to extend into the ladle in proximity to the ladle bottom and to protrude above holding ring upper face, 120, but providing top end, 50, approximately level with parting ring top surface, 102.

Figure 10:
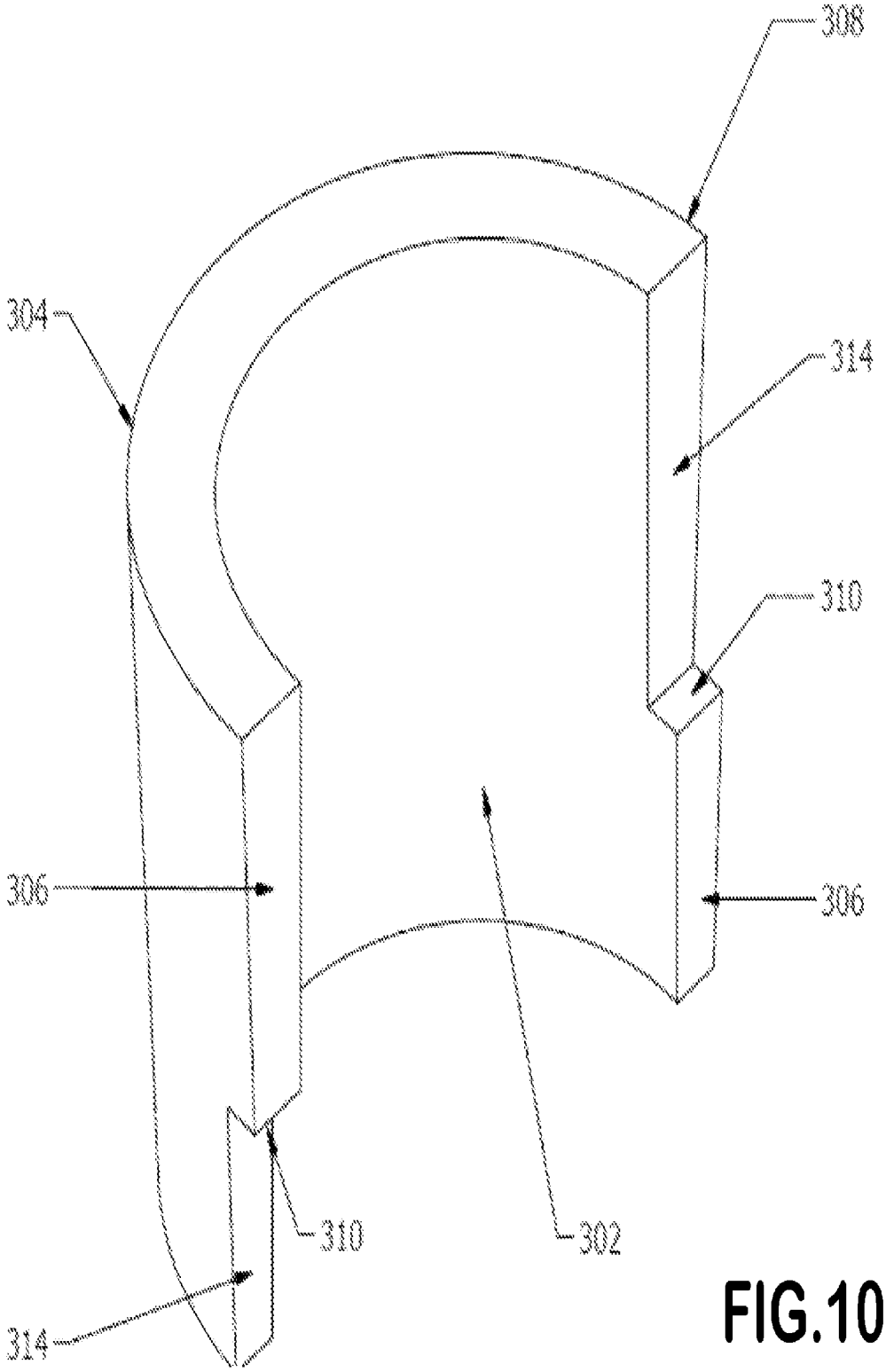
FIG. 10 is an isometric view representation of mating sleeve portions to form a sleeve.
Figure 11:
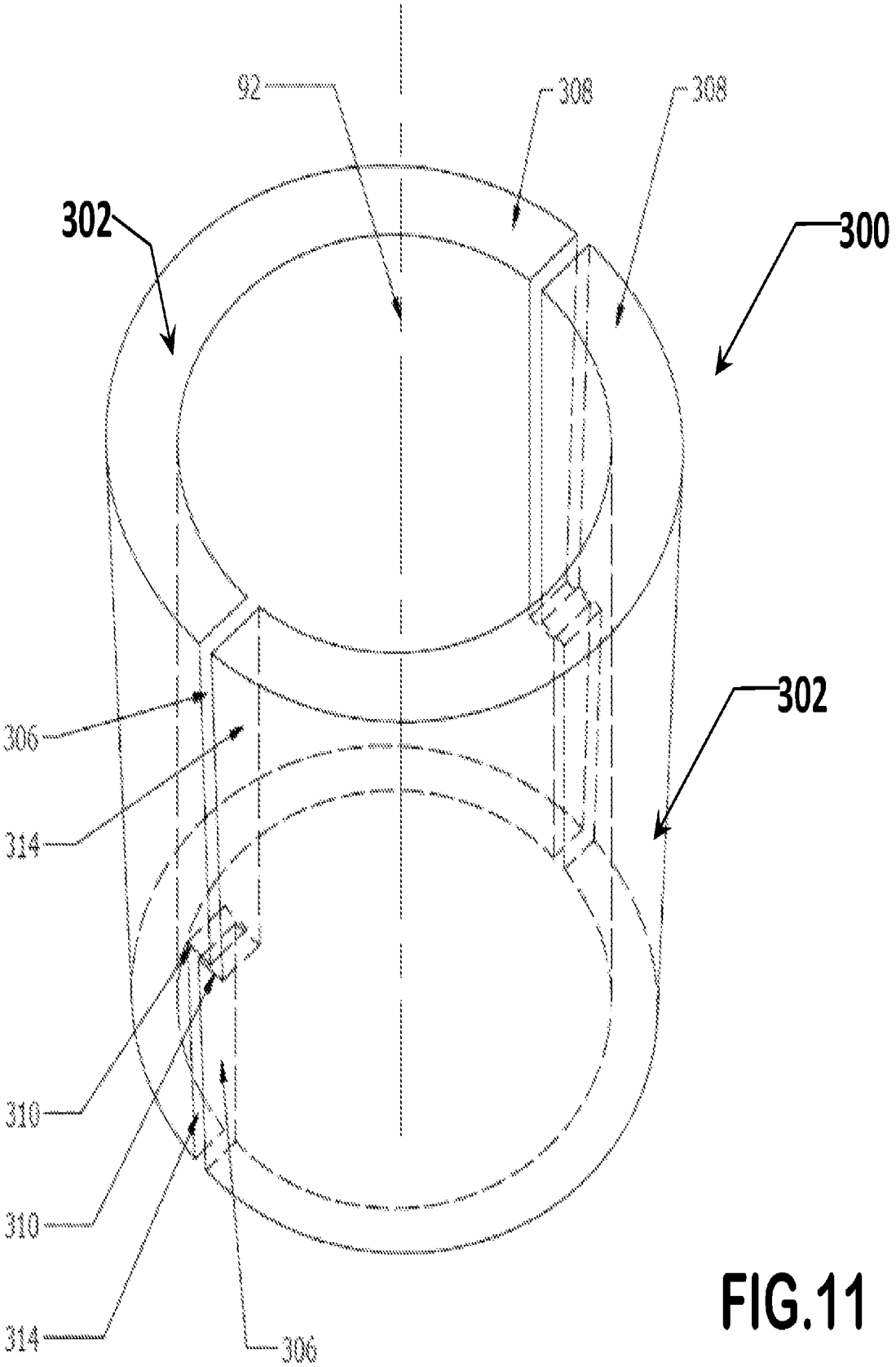
FIG. 11 is an isometric view of a two-portion assembled centering sleeve.

A centering sleeve portion 302 is illustrated in schematic side view in FIG. 10. In FIG. 10, the sleeve portion 302 comprises protrusions, 306, symmetrically disposed on the sleeve portion, 302, wherein the protrusions 306 form a ledge, 310, which is preferably perpendicular to the face of the protrusion 306. A mating pair of sleeve portions 302 would have the adjacent ledges 310 engaged, or interlocked, with each other and a protrusion 306 engaged with an adjacent recess, 314, as illustrated schematically in FIG. 11. The mated adjacent ledges 310 would insure that the mated or interlocked sleeve portions 302 move in concert along the direction of the longitudinal axis, 92, and compressed or constrained from separating laterally, such as within the inner taper of the holding casting 242. The centering sleeve 300 can be assembled from two or more sleeve portions 302 to best fit the gap 61 and maintain centered position of the pouring tube 224. For example, the centering sleeve 300 can be formed in ⅓ portions with similar protrusions, ledges, and recesses of FIG. 11 positioned at adjacent interfaces of each of the three sleeve portions.

The assembled centering sleeve 300 can be press-fit into the gap 61 between the holding casting 242 and the pouring tube 224 such that the pouring tube 224 remains in a compressive state and is centered to the ingate of a casting mold positioned above the pouring tube assembly 218. Cementitious refractory material, or mortar, 9, can be applied in passage 64 or gap 61 between the pouring tube, 224, and the holding casting, 242.

In use, a method for centering a pouring tube in a pouring tube assembly can include the steps of: assembling a multi-piece centering sleeve from sleeve portions; inserting a pouring tube into a holding casting aperture in a holding casting; pouring grout to fill a portion of a gap between the pouring tube and the holding casting; slipping the centering sleeve over the outside of the pouring tube until it is press fit in a portion of the gap between the pouring tube and the holding casting; adjusting the centering sleeve to center-position the pouring tube; grouting the remainder of the gap to fill all voids in the gap; installing a parting ring on top of the holding casting; and installing a holding ring around the holding casting and parting ring.

The method can further include tapering each sleeve portion with an inner taper which mates with a pouring tube taper, tapering each sleeve portion with an outer taper that mates with an inner taper of a gap of said holding casting, mortaring between adjacent edges of sleeve portions, securing the sleeve to the pouring tube by casting the sleeve directly onto tube, securing the sleeve to the pouring tube using pins and grooves, and securing the sleeve to the pouring tube by firing in place using a ceramic bond.

The invention has been described with reference to the preferred embodiments without limit thereto. One of skill in the art would realize additional embodiments and improvements which are not specifically stated but which are within the meets and bounds of the claims appended hereto.

The invention claimed is:

1. A method for centering a pouring tube in a pouring tube assembly, comprising the steps of:

assembling a multi-piece centering sleeve from sleeve portions;

inserting a pouring tube into a holding casting aperture in a holding casting;

pouring grout to fill a portion of a gap between the pouring tube and the holding casting;

slipping the assembled centering sleeve over the outside of the pouring tube until it is press fit in a portion of the gap between the pouring tube and the holding casting;

adjusting the centering sleeve to center-position the pouring tube;

grouting the remainder of the gap to fill all voids in the gap;

installing a parting ring on top of the holding casting; and installing a holding ring around the holding casting and parting ring.

2. The method of claim 1 further comprising tapering each said sleeve portion with an inner taper which mates with a pouring tube taper.

3. The method of claim 1 further comprising tapering each said sleeve portion with an outer taper that mates with an inner taper of a gap of said holding casting.

4. The method of claim 1 further comprising mortaring between adjacent edges of said sleeve portions.

5. The method of claim 1 wherein said sleeve comprises graphite, steel, alumina, magnesia, calcia, mullite, and mixtures thereof.

6. The method of claim 1 further comprising securing the sleeve to the pouring tube by casting the sleeve directly onto tube.

7. The method of claim 1 further comprising securing the sleeve to the pouring tube using pins and grooves.

8. The method of claim 1 further comprising securing the sleeve to the pouring tube by firing in place using a ceramic bond.

* * * * *